US005080201A

United States Patent [19]

Yoo et al.

[11] Patent Number: 5,080,201

[45] Date of Patent: Jan. 14, 1992

[54] DIVERSION OF AIRFLOW AROUND AN ELEVATOR COUNTERWEIGHT

[75] Inventors: Young S. Yoo, Avon; John K. Salmon, South Windsor; Joseph R. Faust, Southington, all of Conn.

[73] Assignee: Otis Elevator Company, Farmington, Conn.

[21] Appl. No.: 503,349

[22] Filed: Apr. 2, 1990

[51] Int. Cl.[5] ..... B66B 17/12

[52] U.S. Cl. ..... 187/94; 187/1 R; 244/138 R

[58] Field of Search ..... 187/94, 1 R; 244/123, 244/130, 138 R, 198

[56] References Cited

U.S. PATENT DOCUMENTS

| | | | |
|---|---|---|---|
| 998,610 | 7/1911 | Goodknight | 187/94 |
| 1,071,309 | 8/1913 | Goggin | 187/94 |
| 3,476,339 | 11/1969 | Pugh | 244/138 R |
| 3,695,177 | 10/1972 | Chakoian et al. | 244/138 R |
| 3,945,468 | 3/1976 | Miura et al. | 187/1 R |

*Primary Examiner*—D. Glenn Dayoan
*Assistant Examiner*—Kenneth Noland
*Attorney, Agent, or Firm*—William W. Jones

[57] ABSTRACT

Air deflectors are mounted on the top and bottom of the counterweight assembly in an elevator system to deflect air in the elevator hoistway to the sides of the counterweight as the latter moves up and down in the hoistway. The deflectors ensure that air turbulence is not directed toward the car as the car and counterweight pass each other in the hoistway. A quieter and smoother passenger ride is thus accomplished. In an ultra high-speed elevator system, the counterweights may be completely enclosed in an aerodynamic jacket. Cable connections and compensating rope connections to the counterweight are all made inboard thereof to ensure that the counterweight is free of turbulence-inducing protuberances.

10 Claims, 2 Drawing Sheets

DIVERSION OF AIRFLOW AROUND AN ELEVATOR COUNTERWEIGHT

TECHNICAL FIELD

This invention relates to an elevator system which produces a smoother, quieter ride at high speed travel rates, and more particularly, to an elevator system having an aerodynamically improved counterweight assembly.

BACKGROUND ART

High speed elevator systems are necessary in modern high rise buildings in order to reduce passenger trip time. Such elevators commonly travel at speeds of one thousand feet per minute and higher. When the elevator car travels at such high speeds, it is important that car noise and vibration be kept at a minimum to ensure passenger comfort. New car suspension assemblies and rail guiding improvements can achieve very quiet and smooth rides over the majority of the path of travel of the car in the hoistway, however, air turbulence will result in the hoistway due to the confined nature of a hoistway, and the high rates of speed at which the elevator car and counterweight move through the hoistway. Such air turbulence is created both by the car and by the counterweight. Car-induced turbulence can cause noise and vibration in the car as the latter passes each landing sill and hoistway door; and car-induced plus counterweight-induced turbulence can cause noise and vibration in the car when the car and counterweight pass each other in the hoistway. This invention is directed toward the reduction of the latter cause of noise and vibration in the car.

U.S. Pat. No. 3,945,468 granted Mar. 23, 1976 to Miura, et al. concerns the reduction of noise and car vibration in an elevator. This patent suggests the use of a long skirt below the car door on the hoistway landing side of the car to reduce sill vibration and noise; and the use of guide plates mounted on the top and bottom of the elevator car to deflect air away from the car. A problem with the car guide plates in the aforesaid patent is that they deflect air toward the counterweight assembly. Thus the guide plate will create a turbulent air condition in the path of travel of the counterweight. When the counterweight passes through this turbulence it will be passing the car and will reflect the turbulence back toward the car. This type of arrangement will increase noise and vibration in the car as the car and counterweight pass each other in the hoistway.

DISCLOSURE OF THE INVENTION

This invention is directed toward a solution to the problem of car noise and vibration induced by the counterweight. In order to control air flow in the hoistway in the vicinity of the counterweight, the latter is provided with air deflectors mounted on both the top and bottom of the counterweight frame. The cable and rope compensator connections are all disposed inboard of the counterweight frame and deflectors, so that there are no turbulence-inducing protuberances on the counterweight at the connections. For ultra-high speed elevator systems, the counterweight frame and components can be jacketed front and back to produce smooth continuous side surfaces facing the elevator car. The invention provides for air to be deflected to the sides of the counterweight, and not toward the car.

It is therefore an object of this invention to provide an improved high-speed elevator system which provides for a smoother, quieter passenger ride.

It is a further object of this invention to provide an elevator system of the character described which produces reduced air turbulence between the car and counterweight as they pass each other in the hoistway.

It is yet another object of this invention to provide an elevator system of the character described which deflects air in the hoistway to the sides of both the car and counterweight.

These and other objects and advantages of this invention will become more readily apparent from the following detailed description of a preferred embodiment thereof when taken in conjunction with the accompanying drawings, in which:

BEST MODE FOR CARRYING OUT THE INVENTION

Figure 2:
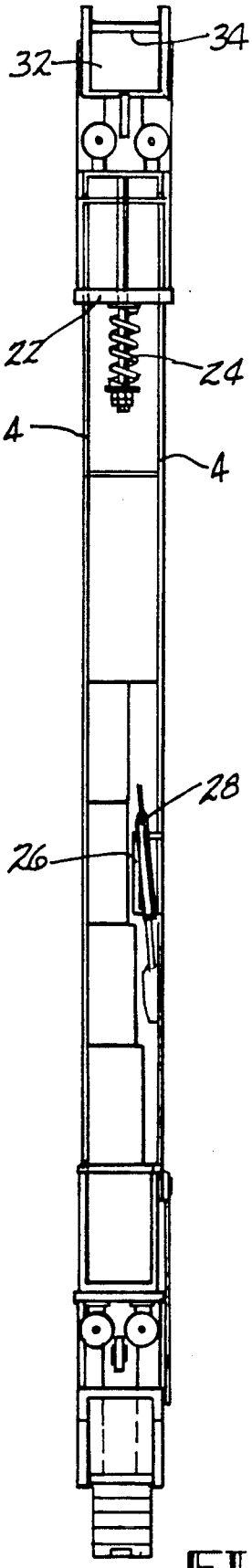
FIG. 2 is a side elevational view of the counterweight assembly showing the manner in which the compensator and cable hitches are recessed in the assembly.
Figure 1:
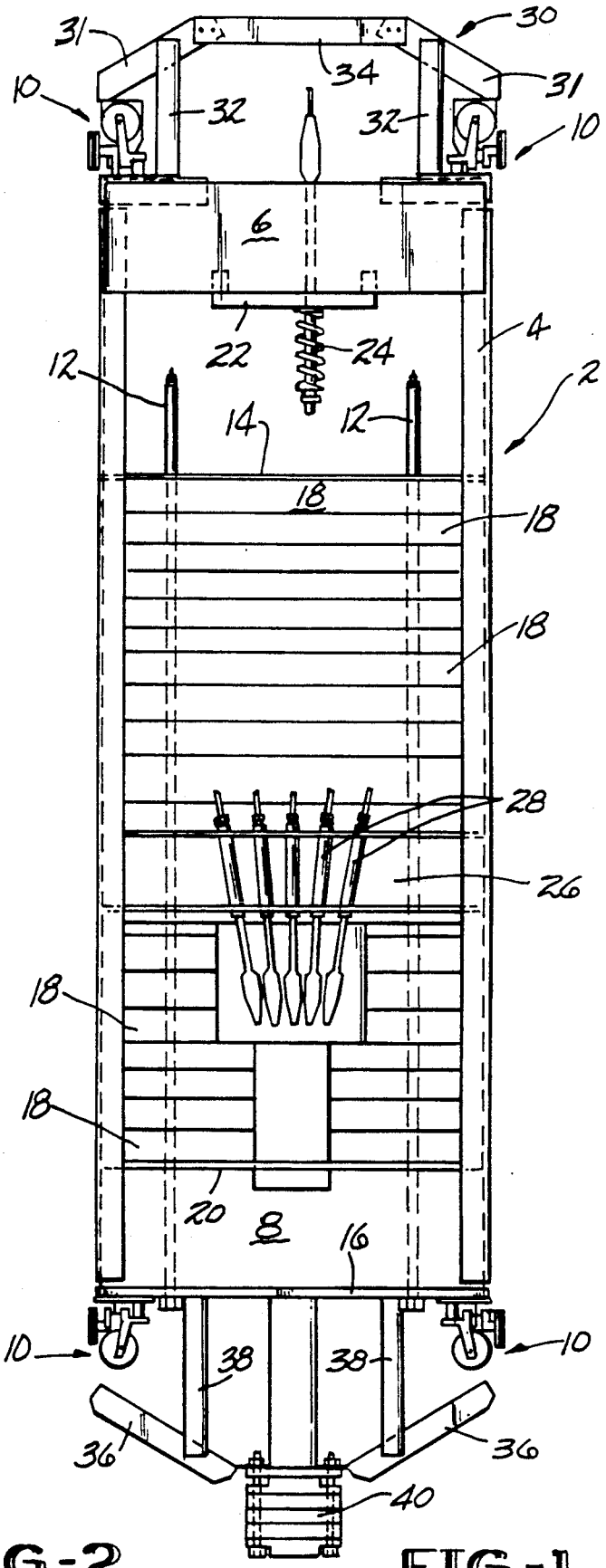
FIG. 1 is a front elevational view of a counterweight assembly having air deflectors mounted on the top and bottom thereof in accordance with this invention.

Referring now to the drawings, there is shown in FIGS. 1 and 2 an elevator counterweight assembly which is denoted generally by the numeral 2. The assembly 2 includes a frame 4 with an upper end cap 6 and a lower end cap 8. Rail guide roller groups 10 are mounted at the outer side edges of the upper and lower end caps 6 and 8 to engage the counterweight guide rails (not shown) which are mounted on the walls of the hoistway. Guide rods 12 extend between an upper cross plate 14 and a lower cross plate 16 and are bolted thereto. The weights 18 extend upwardly from a transverse support plate 20 to the upper cross plate 14, the weights 18 being telescoped over the guide rods 12. A cable hitch plate 22 receives the counterweight cable hitch thimble rod 24. It will be noted from FIG. 2 that the hitchplate 22 and thimble rod 24 are inboard on the counterweight frame 4 so as not to create any turbulence-inducing protrusions on the assembly 2. A compensating rope hitch channel 26 is mounted on the frame 4 to receive the compensating hitch thimbles 28. It will be noted from FIG. 2 that the compensating hitch channel 26 and thimbles 28 are also inboard on the frame 4. An air deflector or foil assembly 30 is mounted on the top or upper end of the counterweight assembly 2. Mounting plates 32 are secured to the upper end cap 6 and extend therefrom above the guide roller sets 10. Downwardly and outwardly flared side air deflectors 32 are connected to the plates 32, and a transverse lead deflector 34 spans the gap between the side deflectors 32 and is connected thereto. As noted in FIG. 2, the deflectors 32 and 34 are trough-shaped. Side deflectors 36 are mounted on plates 38 secured to the lower crossplate 16 on either side of the bumper 40 which contacts the oil buffer mounted in the hoistway pit. The lower deflectors 36 channel air to the sides of the counterweight as the latter moves downwardly through the hoistway.

Figure 3:
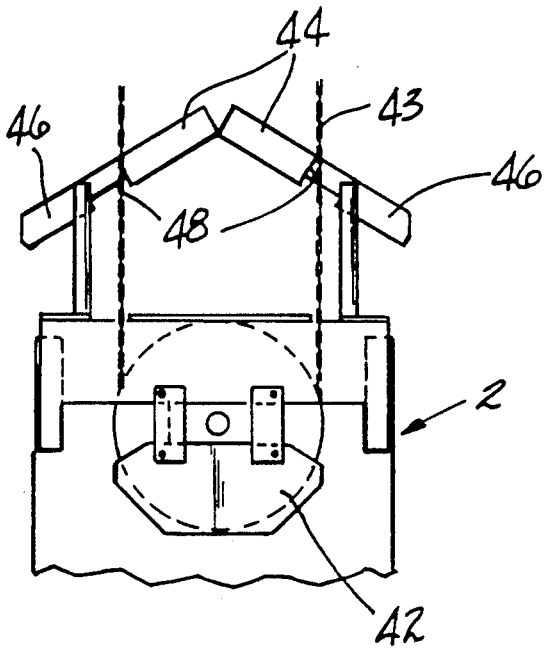
FIG. 3 is a fragmented front elevational view of a counterweight of the type having a cable sheave, and which is provided with air deflectors in accordance with this invention.

FIG. 3 illustrates a counterweight assembly 2 in a 2:1 roped elevator system wherein the counterweight includes a sheave 42 mounted thereon for engagement by the elevator rope 43. The deflectors have two components 44 and 46 which are separated by a gap 48 through which the rope 43 passes.

Figure 4:
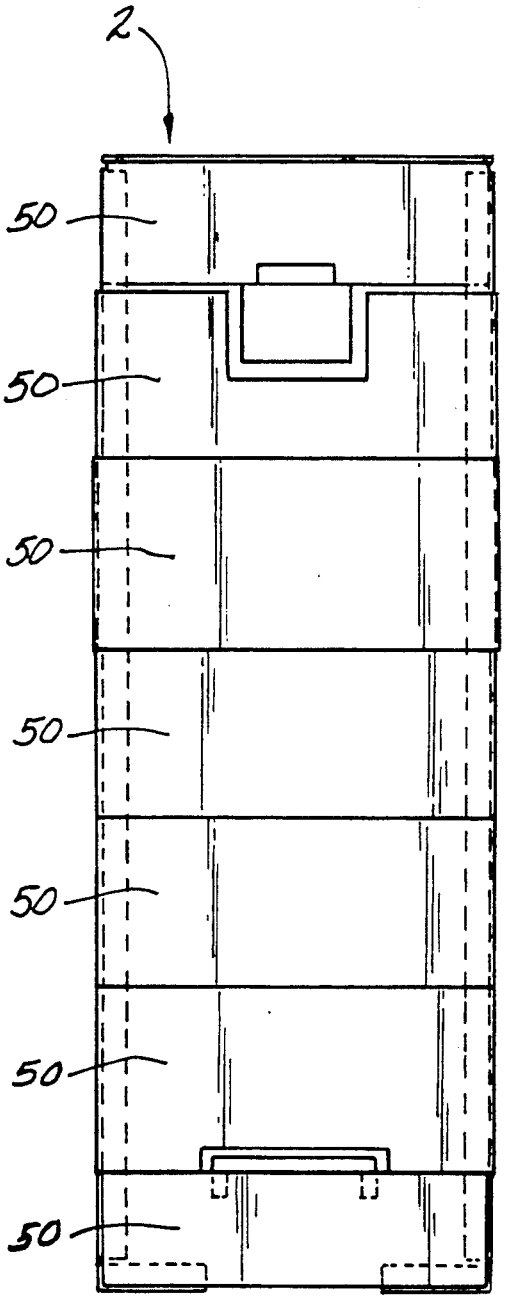
FIG. 4 is a front elevational view of a counterweight assembly which has been completely jacketed to reduce air turbulence in accordance with this invention.

FIG. 4 discloses an embodiment of the counterweight 2 wherein the assembly is completely encased by a plurality of removable plates 50.

It will be readily appreciated that this invention will result in a decrease of hoistway air turbulence induced by the counterweight and directed toward the car as the two pass each other in the hoistway. By eliminating projecting surfaces from the counterweight assembly, and by deflecting air to the sides of the counterweight, the car is subjected to less air turbulence whereby a smoother, quieter ride is attained. The invention has particular advantages in high-speed or ultra high-speed elevator systems.

Since many changes and variations of the disclosed embodiment of the invention may be made without departing from the inventive concept, it is not intended to limit the invention otherwise than as required by the appended claims.

What is claimed is:

1. An elevator counterweight assembly comprising:

a. a frame for holding a plurality of counterweights; and b. air deflector means mounted on an upper end of said frame for deflecting air downwardly over sides of said frame to minimize counterweight-induced air turbulence when said assembly travels upwardly.

2. The assembly of claim 1 wherein said air deflector means comprises opposed channel-shaped deflectors disposed above said upper end of said frame and sloped downwardly and outwardly toward said sides of said frame.

3. The assembly of claim 2 further comprising a plurality of cable hitches on said frame for connection with elevator cables, said hitches being disposed inboard of said frame so as to minimize outboard air turbulence-inducing protuberances on the counterweight assembly.

4. The assembly of claim 2 further comprising a cable sheave mounted adjacent said upper end and inboard of said frame, said cable sheave being disposed beneath said channel-shaped deflectors.

5. The assembly of claim 1 further comprising air deflecting means mounted on a lower end of said frame for deflecting air upwardly over said sides of said frame to minimize counterweight-induced air turbulence when said assembly travels downwardly.

6. The assembly of claim 5 wherein said air deflecting means comprises opposed trough-shaped deflectors disposed below said lower end of said frame and sloped upwardly and outwardly toward said sides of said frame.

7. An elevator counterweight assembly comprising:

a. a frame for holding a plurality of counterweights; and b. air deflecting means mounted on a lower end of said frame for deflecting air upwardly over sides of said frame to minimize counterweight-induced air turbulence when said assembly travels downwardly.

8. The assembly of claim 7 further comprising a plurality of cable hitches on said frame for connection with elevator cables, said hitches being disposed inboard of said frame so as to minimize outboard air turbulence-inducing protuberances on the counterweight assembly.

9. The assembly of claim 7 wherein said air deflecting means comprises opposed trough-shaped deflectors disposed below said lower end of said frame and sloped upwardly and outwardly toward said sides of said frame.

10. An elevator counterweight assembly comprising:

a. a frame for holding a plurality of counterweights;

b. air deflector means mounted on an upper end of said frame for deflecting air downwardly over sides of said frame when said assembly travels upwardly;

c. air deflecting means mounted on a lower end of said frame for deflecting air upwardly over said sides of said frame when said assembly travels downwardly; and d. said air deflector and air deflecting means being operable to minimize counterweight-induced air turbulence in an elevator hoistway.

* * * * *